United States Patent [19]

Liu

[11] Patent Number: 4,643,807

[45] Date of Patent: Feb. 17, 1987

[54] PROCESS FOR ELECTROCHEMICALLY FORMING AN AROMATIC COMPOUND CONTAINING ONE OR MORE ALPHA-ACYLOXYLATED ALIPHATIC SUBSTITUTENT(S)

[75] Inventor: Ming-Biann Liu, Midland, Mich.

[73] Assignee: The Dow Chemical Company, Midland, Mich.

[21] Appl. No.: 808,777

[22] Filed: Dec. 13, 1985

[51] Int. Cl.[4] ..... C25B 3/02

[52] U.S. Cl. ..... 204/78

[58] Field of Search ..... 204/78

[56] References Cited

U.S. PATENT DOCUMENTS 4,212,711 7/1980 Halter et al. ..... 204/78
4,406,758 6/1983 McIntyre et al. ..... 204/98
4,411,746 10/1983 Degner et al. ..... 204/78
4,482,439 11/1984 Toomey ..... 204/78

FOREIGN PATENT DOCUMENTS 148781 5/1979 Japan ..... 204/78

OTHER PUBLICATIONS

*Yuki Gosei Kagaku,* 37 (11), pp. 914–934 (1979).

Bel'-SKii et al., *Russian Journal of Physical Chemistry,* 38 (8), 1061 (1964).

Ruthner et al., *Journal of Catalysis,* 38, pp. 264–272 (1975).

*Primary Examiner*—R. L. Andrews

[57] ABSTRACT

Strong acid electrolytes are useful to acetoxylate substituted ethylbenzenes in acetic acid to substituted $\alpha$-acetoxyethylbenzenes which can be converted to substituted vinylbenzenes.

22 Claims, No Drawings

PROCESS FOR ELECTROCHEMICALLY FORMING AN AROMATIC COMPOUND CONTAINING ONE OR MORE ALPHA-ACYLOXYLATED ALIPHATIC SUBSTITUTENT(S)

BACKGROUND OF THE INVENTION

This invention relates to the formation of aromatic compounds containing one or more α-acyloxylated aliphatic substituent(s).

These aromatic compounds containing one or more α-acyloxylated aliphatic substituent(s) are useful reaction intermediates. For example, some may be pyrolyzed into aromatic compounds containing one or more α,β-unsaturated aliphatic substituent(s) which are useful cross-linkers and monomers for use in ethylenically unsaturated polymerization reactions.

In the electrochemical formation of compounds, the reactants are contacted with two electrodes in the presence of one or more electrolytes, in which there is an electrical potential between the electrodes. Occasionally, the reactants are the only electrolyte(s). The electrolyte(s) must conduct electrical current through the reacting solution between the electrodes. The electrolyte(s) must also allow the formation of the desired product. Strong acids are a well-known class of electrolyte. They have heretofore not been used for electrolytes in the electrochemical formation of α-acyloxylated alkylarenes because they have been perceived as not allowing the formation of aromatic compounds containing one or more α-acyloxylated aliphatic substituent(s). See, for example, *Yuki Gosei Kagaku,* 37 (11), pp. 914–934 (1979). Since strong acids are inexpensive, effective electrolytes, it would be desirable to provide a process employing one or more strong acid electrolytes in the electrochemical formation of aromatic compounds containing one or more α-acyloxylated aliphatic substituent(s).

SUMMARY OF THE INVENTION

This invention is a process for forming aromatic compounds containing one or more α-acyloxylated aliphatic substituent(s). The process comprises the step of contacting a solution containing an aromatic compound having at least one aliphatic substituent with two electrodes. There is an electrical potential between the two electrodes. This contact is in the presence of (1) a strong acid electrolyte and (2) an alkanoic acid. This contact is under conditions sufficient to form an aromatic compound containing one or more α-acyloxylated aliphatic substituent(s).

These aromatic compounds containing one or more α-acyloxylated aliphatic substituent(s) which possess at least 2 carbon atoms bonded to an aromatic carbon atom can be pyrolyzed to form aromatic compounds containing one or more α,β-unsaturated aliphatic substituent(s) which possess at least 2 carbon atoms bonded to an aromatic carbon atom, which are useful cross-linkers and monomers for use in ethylenically unsaturated polymerization reactions.

These aromatic compounds containing one or more α-acyloxylated aliphatic substituent(s) can be hydrolyzed to form α-hydroxy aliphatic-substituent aromatic compounds, which are useful as reaction intermediates, solvents and, if polyfunctional, as cross-linkers and monomers for use in polyester polymerization reactions.

DETAILED DESCRIPTION OF ILLUSTRATIVE EMBODIMENTS

Aromatic compounds containing one or more aliphatic substituent(s) suitable in practicing this invention are those which form aromatic compounds containing one or more α-acyloxylated aliphatic substituent(s). Preferably, they are represented by the formula, R—Ar, in which R is a monovalent aliphatic substituent and Ar is a monovalent aromatic radical. Both R and Ar may contain one or more substituents and/or heteroatoms. These substituents and heteroatoms, if present, are essentially unreactive. Preferred substituents are deactivating moieties. Preferred heteroatoms are oxygen and sulfur. R is bonded to an aryl ring of the aromatic radical. Preferably, R radicals contain from 1 to about 10 carbon atoms, more preferably less than about 6 carbon atoms and most preferably less than about 4 carbon atoms. More preferably, the R radicals contain more than 2 carbon atoms. Preferable Ar radicals contain only one benzene ring. More preferable Ar radicals are ring-substituted with one or more deactivating moieties. These deactivating moieties, if present, are essentially unreactive. Preferably, the aromatic compound containing one or more aliphatic substituent(s) only contain one aliphatic substituent.

Essentially unreactive means that during the electrochemical formation of the aromatic compounds containing one or more α-acyloxylated aliphatic substituent(s) the essentially unreactive material does not react to a degree sufficient to prevent the formation of the aromatic compounds containing one or more α-acyloxylated aliphatic substituent(s). Preferably, less than about 10 percent reacts, more preferably less than about 5 percent reacts and most preferably less than about one percent reacts.

Preferred deactivating moieties are chloro, bromo, $$-\overset{\overset{\displaystyle O}{\|}}{C}-OR \text{ and } -\overset{\overset{\displaystyle O}{\|}}{C}-OH,$$

in which R is as previously defined. More preferred moieties are chloro and bromo. The most preferred moiety is bromo.

Preferred aromatic compounds containing one or more aliphatic substituent(s) are ethyl methylbenzoate, methyl methylbenzoate; methyl ethylbenzoate; ethyl ethylbenzoate; 2-bromoethylbenzene; 4-bromoethylbenzene; dibromoethylbenzenes; 2,4,5-tribromoethylbenzene; 2,3,4,5-tetrabromoethylbenzene; 2,3,5,6-tetrabromoethylbenzene; 2,3,4,6-tetrabromoethylbenzene; 2,3,4,5,6-pentabromoethylbenzene and their chloro homologues. More preferred aromatic compounds containing one or more aliphatic substituent(s) are methyl ethylbenzoate and dibromoethylbenzenes. The most preferred aromatic compounds containing one or more aliphatic substituent(s) are dibromoethylbenzenes.

Suitable alkanoic acids which function as a solvent for the other components of the solution and also function as a reactant are the $C_1$ to about $C_{10}$ acids. Preferred are the $C_{2-6}$ acids such as acetic, trifluoroacetic acid, propionic, butanoic and pentanoic and their isomers, and the various hexanoic acids. Branched- as well as straight-chain acids are useful, including such acids as 2-methylbutyric, 3-methylbutyric and trimethylacetic.

Mixtures of the preceding alkanoic acids may also be used. Mixtures of solvents which contain one or more alkanoic acids may be used if the aromatic compound containing one or more aliphatic substituent(s) is dissolved in the reaction mixture and the solvents are essentially unreactive. For example, minor amounts of water in acetic acid is generally a suitable solvent mixture. By minor amount it is meant less than 5 weight percent based on the alkanoic acid.

Suitable strong acids are those which test as strong acid in the desired solvent or solvent mixture by the technique of Bel'Skii et al., *Russian Journal of Physical Chemistry,* 38 (8), 1061 (1964), now incorporated herein by reference. Preferred are homogeneous acids which have a pH below about 1 in a 1-molar aqueous solution. Suitable strong acids in acetic acid include $H_2SO_4$, $BF_3$, $HClO_4$, sulfonated polystyrene beads, trifluoroacetic acid, fluoroacetic acid and combinations thereof.

The electrodes may be carbon or graphite, or formed from any essentially unreactive metal such as platinum, silver, nickel, lead, etc. The anode is preferably carbon, platinum or gold, whereas the cathode may be any essentially unreacted metal. It is most preferred that both electrodes are graphite. Forms of the electrodes are conventional.

The current density may be maintained over a fairly wide range, preferably from about 0.001 to about 1.0, and more preferably from about 0.01 to about 0.26, amp/sq cm. The current density value determines the rate of the electrolysis. Applied voltage is supplied by any suitable voltage source, including pulsating DC sources and low frequency AC source. The electrical potential between the electrodes is sufficient to produce the desired current density, preferably, between about 5 and about 50 volts.

For the reaction, ambient temperatures are preferred, e.g., from about 20° C. to about 40° C., although higher temperatures are useful, e.g., up to the boiling point of the solution. It is preferred to conduct the electrolysis at atmospheric pressures but super- and subatmospheric pressures can be used and superatmospheric pressures may be desirable if highly elevated temperatures are used to prevent boiling of the solution. Pressures less than about 10 atmospheres are preferred if superatmospheric pressures are used. If desired, a diaphragm of conventional material, such as those described in U.S. Pat. No. 4,406,758, may be used to separate the cathode from the anode in order to prevent possible reaction of the products formed at one electrode with those at the other. Agitation is desirable but can be omitted.

The reacting solution is contained in an electrochemical cell. Conventional cells may be used. The cell may be constructed of any material which will contain the reacting solution and not prevent the formation of an aromatic compound containing one or more α-acyloxylated aliphatic substituent(s). All portions of the cell which come in contact with the reacting solution are preferably resistant to acidic solutions. More preferred cells are constructed of glass, graphite, stainless steel and other materials commonly used in electrochemical cells. The electrochemical cells of U.S. Pat. No. 4,488,944 can be used in the practice of this invention.

While any amount of oxidation will produce aromatic compounds containing one or more α-acyloxylated aliphatic substituent(s), preferred are oxidations where the charge passed through the solution (Q) is between about 0.5 and about 3.0 times the theoretical charge of two electrons per molecule. More preferred are processes where Q is less than about 2.5. Even more preferred are processes where Q is less than about 2.0. Most preferred are processes where Q is less than about 1.5. More preferred are processes where Q is greater than about 0.7. Most preferred are processes where Q is greater than about 0.9. Charge is the time integral of electrical current flow. Multiplying average current flow by elapsed time yields the charge passing in the elapsed time. A Coulometer directly measures the time integral of current which is the charge passed through the circuit which contains the Coulometer.

The aromatic compound containing one or more α-acyloxylated aliphatic substituent(s) can be recovered by conventional techniques such as distillation and crystallization.

Preferred conversions of the aromatic compound containing one or more aliphatic substituent(s) is above about 30 percent, more preferably above about 50 percent and most preferably above about 60 percent. Preferred current efficiencies to aromatic compounds containing one or more α-acyloxylated aliphatic substituent(s) are above about 20 percent, more preferably above about 40 percent, even more preferably above about 60 percent and most preferably above about 70 percent. Current efficiency is the percentage of current flowing through the cell which forms aromatic compounds containing one or more α-acyloxylated aliphatic substituent(s). It is calculated by multiplying the quotient of two times the moles of aromatic compounds containing one or more α-carboxylated aliphatic substituent(s) divided by the moles of electrons which flowed through the cell, by 100 percent.

The aromatic compounds containing one or more α-acyloxylated aliphatic substituent(s), at least one of which possesses at least two carbon atoms, can be converted to aromatic compounds containing one or more α,β-unsaturated aliphatic substituent(s) by hot tube pyrolysis as discussed in Ruthner et al., *Journal of Catalysis,* 38, pp. 264–272 (1975). The aromatic compounds containing one or more α-acyloxylated aliphatic substituent(s) can be hydrolyzed in water by the conventional use of caustic. This invention is further illustrated by the following nonlimiting examples.

EXAMPLE 1

A mixture of 10.16 g (0.03 mole) of 2,4,5-tribromoethylbenzene; 4.94 g (0.05 mole) of 98 percent sulfuric acid and 61.5 g (1.03 mole) of glacial acetic acid are electrolyzed. The electrolysis is conducted in a glass cell equipped with two 0.5-inch (1.3-cm) diameter cylindrical electrodes which are submerged 1.5 inches (3.8 cm) in the reaction mixture. The electrode gap is 0.25 inches. The electrolysis is conducted at 0.4 Amperes (A) until a charge of 6003 coulombs (250 minutes) passes through the cell. This charge is 1.05 times the theoretical charge. The cell voltage is 26 volts direct current (VDC). The resulting solution is taken and is subjected to vacuum distillation at a temperature of 80° C. and a pressure of 20 mm Hg to remove the remaining acetic acid. This vacuum distillation leaves an oily residue, which is dissolved in 50 ml of carbon tetrachloride and washed with 50-ml aliquots of water three times to remove remaining sulfuric acid. The washed solution is analyzed by gas chromatography and nuclear magnetic resonance spectroscopy. These analyses indicate that 65 percent of the 2,4,5-tribromoethylbenzene is converted to 2,4,5-tribromo-α-acetoxyethylbenzene with a current efficiency of 62 percent.

EXAMPLE 2

Example 1 is repeated except using 6.48 g (0.019 mole) of 2,4,5-tribromoethylbenzene; 3.39 g (0.024 mole of 71 percent perchloric acid and 51.33 g (0.86 mole) of glacial acetic acid. The electrolysis is conducted at 0.4 A until a charge of 3507 coulombs (146 minutes) passes through the cell. This charge is 0.96 times the theoretical charge. The cell voltage is 15 VDC. The residue is analyzed by gas chromatography and nuclear magnetic resonance spectroscopy. These analyses indicate that 42 percent of the 2,4,5-tribromoethylbenzene is converted to 2,4,5-tribromo-α-acetoxyethylbenzene with a current efficiency of 44 percent.

The 30 percent reduction in the current efficiency between Examples 1 and 2 may be a result of the 60 percent lower strong acid concentration (moles acid/-mole acetic acid). It may also be due to the different acid used.

EXAMPLE 3

Example 1 is repeated except using 10.2 g (0.03 mole) of 2,4,5-tribromoethylbenzene; 5.6 g (0.04 mole of boron trifluoride etherate and 50 ml (0.87 mole) of glacial acetic acid. The electrolysis is conducted at 0.2 A (10 milliamperes/cm$^2$) until a charge of 7340 coulombs (611 minutes) passes through the cell. This charge is 1.3 times the theoretical charge. The cell voltage is 38 VDC. The washed solution is analyzed by gas chromatography and nuclear magnetic resonance spectroscopy. These analyses indicate that 45 percent of the 2,4,5-tribromoethylbenzene is converted to 2,4,5-tribromo-α-acetoxyethylbenzene with a current efficiency of 36 percent.

EXAMPLE 4

A mixture of 163.40 g (0.62 mole) of dibromoethylbenzene, 42.9 g (0.43 mole of 98 percent sulfuric acid and 400 ml (420 g, 7.0 moles) of glacial acetic acid are electrolyzed. The electrolysis is conducted by circulating the solution through a Teflon electrochemical cell equipped with two 4-inch (10-cm)×4-inch (10-cm) graphite plate electrodes. The cell is operated at 3.5 A (35 milliamperes/cm$^2$) until a charge of 181,250 coulombs (863 minutes) passes through the cell. This charge is 1.5 times the theoretical charge. The cell voltage is 12 VDC. A 50-g sample of the product mixture is taken and is subjected to vacuum distillation at a temperature of 80° C. and a pressure of 20 mm Hg to remove the remaining acetic acid. This vacuum distillation leaves an oily residue, which is dissolved in 150 ml of carbon tetrachloride and washed with 150-ml aliquots of water three times to remove remaining acid. The washed solution is analyzed by gas chromatography. This analysis indicates that 83 percent of the 2,4,5-tribromoethylbenzene is converted to 2,4,5-tribromo-α-acetoxyethylbenzene with a current efficiency of 55 percent.

Example 4 uses a different cell than the first three examples. Example 4 also has a 50 percent increase in current flow per mole of reactant relative to Example 1, which uses the same acid. These differences may account for the slightly lower current efficiency and higher conversion that Example 1 and higher current efficiency than Examples 2 and 3.

EXAMPLE 5

Example 4 is repeated except using 197.4 g (0.75 mole) of dibromoethylbenzene, 5.6 g (0.04 mole) of boron trifluoride etherate and 300 ml (315 g, 5.2 moles) of glacial acetic acid are electrolyzed. The cell is operated at 3 A (30 milliamperes/cm$^2$) until a charge of 146,000 coulombs (811 minutes) passes through the cell. This charge is 1.01 times the theoretical charge. The cell voltage is 24 VDC. The washed solution is analyzed by gas chromatography. This analysis indicates that 49.4 percent of the 2,4,5-tribromoethylbenzene is converted to 2,4,5-tribromo-α-acetoxyethylbenzene with a current efficiency of 48.9 percent.

Example 5 uses a different cell than Example 2, which uses the same strong acid. Example 5 also has a 30 percent reduction in current flow per mole of reactant than does Example 3. These differences may account for the higher conversion and current efficiency of Example 5 over Example 3.

I claim:

1. A process for forming aromatic compounds containing one or more α-acyloxylated aliphatic substituent(s) comprising the step of contacting two electrodes with a solution containing an aromatic compound having one or more aliphatic substituent(s) in the presence of (1) a strong acid electrolyte and (2) an alkanoic acid under conditions sufficient to form an aromatic compound containing one or more α-acyloxylated aliphatic subtituent(s).

2. The process of claim 1 in which the aromatic compound containing one or more aliphatic substituents only contains one such aliphatic substituent.

3. The process of claim 1 in which the aromatic compound containing one or more aliphatic substituent(s) is represented by the formula, R—Ar, in which R is the aliphatic substituent and Ar is a monovalent chromate radical, wherein optionally R and Ar contain one or more essentially unreactive substituents and/or heteroatoms.

4. The process of claim 3 in which R contains from 1 to about 10 carbon atoms.

5. The process of claim 4 in which R contains from 2 to about 10 carbon atoms.

6. The process of claim 3 in which Ar contains only one benzene ring.

7. The process of claim 4 in which Ar is ring-substituted with one or more essentially unreactive deactivating moieties.

8. The process of claim 7 in which the deactivating moiety is chloro, bromo, $$-\overset{\overset{\displaystyle O}{\|}}{C}-OR \text{ or } -\overset{\overset{\displaystyle O}{\|}}{C}-OH,$$

wherein R is as previously defined.

9. The process of claim 8 in which the deactivating moiety is bromo.

10. The process of claim 1 in which the aromatic compound containing one or more aliphatic substituent(s) is ethyl methylbenzoate; methyl methylbenzoate; methyl ethylbenzoate; ethyl ethylbenzoate; 2-bromoethylbenzene; 4-bromoethylbenzene; dibromoethylbenzenes; 2,4,5-tribromoethylbenzene; 2,3,4,5-tetrabromoethylbenzene; 2,3,5,6-tetrabromoethylbenzene; 2,3,4,6-tetrabromoethylbenzene; ·2,3,4,5,6-pentabromoethylbenzene or their chloro homologues.

11. The process of claim 1 in which the alkanoic acid is a $C_1$ to about $C_{10}$ acid.

12. The process of claim 1 in which strong acid has a pH in one-molar water solution below about 1.

13. The process of claim 1 in which the strong acid is $H_2SO_4$, $BF_3$, sulfonated polystyrene beads, trifluoroacetic acid, fluoroacetic acid or a combination thereof.

14. The process of claim 13 in which the strong acid is $H_2SO_4$ or $BF_3$.

15. The process of claim 1 in which the electrodes are both graphite.

16. The process of claim 1 in which the current density is between about 0.001 and about 1.0 amperes/-square centimeter of the cathode.

17. The process of claim 1 in which the process is conducted at a temperature between about 20° C. and the boiling point of the reacting solution.

18. The process of claim 1 in which the pressure is between about 10 atmospheres and about atmospheric pressure.

19. The process of claim 1 in which a charge passed through the solution, Q, is between about 0.5 and about 3.0 times the theoretical charge.

20. The process of claim 1 in which the conversion of aromatic compound containing one or more aliphatic substituent(s) is greater than about 30 percent.

21. The process of claim 1 in which the current efficiency to aromatic compounds containing one or more $\alpha$-acyloxylated aliphatic substituent(s) is greater than about 20 percent.

22. The process of claim 11 wherein the alkanoic acid is acetic acid.

* * * * *